US007549812B2

(12) United States Patent
Wu et al.

(10) Patent No.: US 7,549,812 B2
(45) Date of Patent: Jun. 23, 2009

(54) PRINT CONTROL MODULE OF THERMAL PRINTER

(75) Inventors: Min-Chuan Wu, Taipei County (TW); Ching-Huan Tseng, Hsinchu (TW); Yao-Niang Yao Tseng, legal representative, Hsinchu (TW); Yu-Jen Su, Taipei (TW); Hui-Chun Ho, Tai-Chung (TW)

(73) Assignee: Lite-On Technology Corp., Neihu, Taipei (TW)

( * ) Notice: Subject to any disclaimer, the term of this patent is extended or adjusted under 35 U.S.C. 154(b) by 323 days.

(21) Appl. No.: 11/458,998

(22) Filed: Jul. 20, 2006

(65) Prior Publication Data

US 2008/0003042 A1 Jan. 3, 2008

(30) Foreign Application Priority Data

Jun. 28, 2006 (TW) ..... 95123339 A

(51) Int. Cl.
*B41J 13/00* (2006.01)

(52) U.S. Cl. ..... 400/578; 74/640

(58) Field of Classification Search ..... 74/640, 74/473.1; 400/578; 475/207, 331
See application file for complete search history.

(56) References Cited

U.S. PATENT DOCUMENTS 6,547,689 B2 * 4/2003 Baker, Jr. ..... 475/331
6,585,368 B1 * 7/2003 Park ..... 347/103

FOREIGN PATENT DOCUMENTS

TW 427258 3/2001

* cited by examiner

*Primary Examiner*—Marissa L Ferguson-Samreth
(74) *Attorney, Agent, or Firm*—Winston Hsu

(57) ABSTRACT

A print control module for a thermal printer includes a housing, a transmission device, a first driving mechanism, a second driving mechanism, and a power switching mechanism all installed in the housing. The transmission device includes a motor, and a transmission gears set for transmitting power of the motor. When the motor rotates in a first direction, the power switching mechanism transfers power of the motor to the first driving mechanism, and when the motor rotates in a direction opposite to the first direction, the power switching mechanism fixes the first driving mechanism and transfers power of the motor to the second driving mechanism.

4 Claims, 26 Drawing Sheets

PRINT CONTROL MODULE OF THERMAL PRINTER

BACKGROUND OF THE INVENTION

1. Field of the Invention

The present invention relates to a print control module of a thermal printer, and more particularly, to a print control module capable of utilizing a single motor to complete a printing operation.

2. Description of the Prior Art

In general, color printers can be classified into four primary categories: dot matrix printers, inkjet printers, laser printers, and thermal sublimation (or thermal transfer) printers. Recently, the thermal sublimation printers have become increasingly popular due to their full tone printing capability. The thermal sublimation printer drives a thermal print head (TPH) to heat ribbons containing dyes. The dyes are thereafter transferred onto an object (i.e., the target object to be printed, for example, a sheet of paper). In this way, continuous-tone printing can be formed on the object according to the heating time or the heating temperature related to the thermal print head and the ribbons containing dyes.

In general, a print module of a thermal printer usually includes three components, such as a ribbon, a paper feed and a print head. In the conventional technology, these three components are driven (i.e., moved, rotated, powered, and so on) by three motors, which respectively execute steps such as driving, completing the ribbon search, feeding of paper, and printing. However, the utilization of three motors to achieve said component control will increase a total weight of the conventional thermal printer. Additionally, the conventional thermal printer's cost and electricity consumption are far from minimal especially considering that in some certain steps, two motors are required to complete a single operation (e.g., one of the said operations performed by one of the said components). As for a small and portable printer, in order to fulfill the portability requirement, the size of the printer has to be small, and the printer has to be light. Furthermore, portable printers often utilize a battery, therefore electricity consumption has to be low as well. Hence, the conventional thermal printer that utilizes the three motors cannot comply with the requirements of a small and portable printer. Therefore, the application of the conventional thermal printer is limited.

SUMMARY OF THE INVENTION

The claimed invention relates to a print control module of a thermal printer. The print control module comprises a housing; a transmission device installed within the housing. The transmission device comprises a motor; and a transmission gear set for outputting power of the motor. The print control module further comprises a first driving mechanism installed within the housing; a second driving mechanism installed within the housing; and a power switch mechanism installed within the housing. The power switch mechanism further comprises a first rotating arm plate; a first gear installed on the first rotating arm plate for meshing with a gear of the transmission gear set in a rotatable manner relative to the first rotating arm plate; and a first planetary gear installed on the first rotating arm plate for meshing with the first gear for rotating around the first gear in a rotatable manner relative to the first rotating arm plate. The print control module further comprises a fixed component installed on the first rotating arm plate; a second rotating arm plate; a second gear installed on the second rotating arm plate in a rotating manner relative to the second arm plate; a second planetary gear installed on the second rotating arm plate for meshing with the second gear for rotating around the second gear in a rotatable manner relative to the second rotating plate; and an axle connected between a spindle of the first gear and a spindle of the second gear for simultaneously driving the first gear and the second gear; wherein when the motor rotates in a first direction, the first planetary gear meshes with the first driving mechanism to output power to the first driving mechanism, and when the motor rotates in an opposite direction to the first direction, the fixed component fixes the first driving mechanism, the second planetary gear meshes with the second driving mechanism to transfer power to the second driving mechanism.

The claimed invention further discloses a print control module of a thermal printer. The print control module comprises a housing; a transmission device installed within the housing. The transmission device comprises a motor; and a transmission gear set for outputting power of the motor. The print control module further comprises a power switch mechanism installed within the housing. The power switch mechanism comprises a rotating arm plate; a first gear, installed on the rotating arm plate for meshing with a gear of the transmission gear set in a rotatable manner relative to the first rotating arm plate; a first planetary gear installed on the first rotating arm plate for meshing with the first gear for rotating around the first gear in a rotatable manner relative to the first rotating arm plate; a fixing component installed on the first rotating arm plate; a second rotating arm plate; a second gear installed on the second rotating arm plate in a rotating manner relative to the second arm plate; a second planetary gear installed on the second rotating arm plate for meshing with the second gear for rotating around the second gear in a rotatable manner relative to the second rotating plate; and an axle connected between a spindle of the first gear and a spindle of the second gear for simultaneously driving the first gear and the second gear. The print control module further comprises a power transmission gear installed within the housing in a rotatable manner relative to the housing; and a step switch mechanism installed within the housing. The step switch mechanism comprises a third gear installed within the housing for meshing with a print head gear set in a rotatable manner relative to the housing; a cam rotating arm connecting to the third gear comprising a flat surface and an arc surface for switching operation step of the thermal printer through the flat surface and arc surface; a third planetary gear installed on the cam rotating arm for meshing with the power transmission gear for rotating around the power transmission gear in a rotatable manner relative to the cam rotating arm; a rotating arm installed within the housing in a rotatable manner relative to the housing, an end of the rotating arm contacting the cam rotating arm, another end of the rotating arm moving along an arc; and a clutch gear installed on another end of the rotating arm; wherein when the motor rotates in a first direction, the first planetary gear meshes with the step switching mechanism to output power to the step switching mechanism, and when the motor rotates in an opposite direction to the first direction, the fixed component fixes the step switching mechanism, the second planetary gear meshes with the power transmission gear to transfer power to the power transmission gear; wherein the flat surface and the arc surface control the rotation of the rotating arm so as to control the clutch gear to mesh with a ribbon gear set or not.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
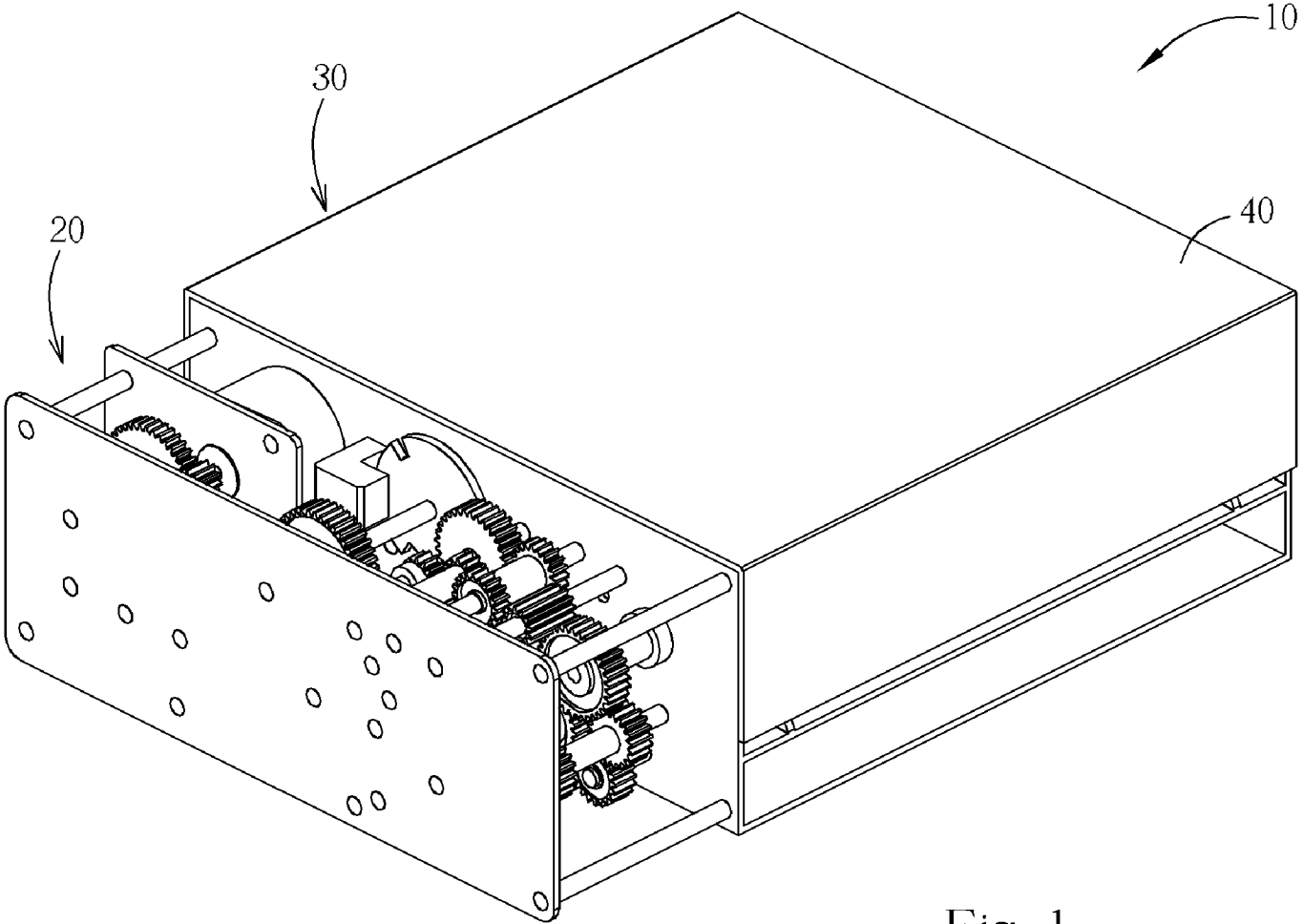
FIG. 1 illustrates a diagram of a thermal printer of the present invention.

Please refer to FIG. 1. FIG. 1 illustrates a diagram of a thermal printer 10 of the present invention. The thermal printer 10 includes a print control module 20, a print device 30, and a housing 40. The print device 30 includes a ribbon shaft, a paper feed roller, and a print head for performing a printout. The print control module 20 can control the print device 30 for driving the print head, the ribbon shaft, and the paper feed roller.

For a clearer explanation of the present invention, the architecture of the print control module 20 will first be explained, follow by the related method.

Figure 2:
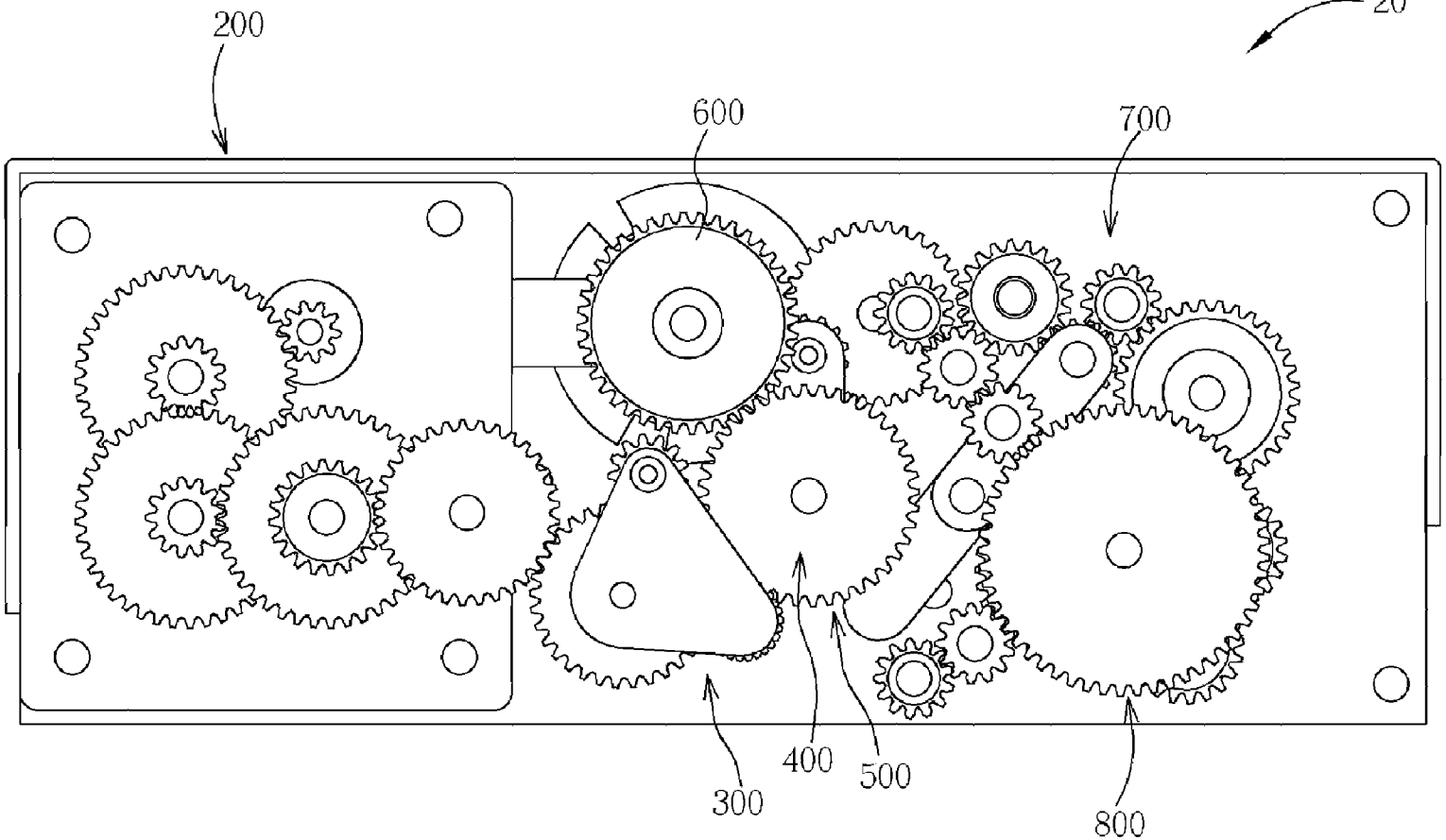
FIG. 2 illustrates a side view diagram of a print control module of the present invention.

Please refer to FIG. 2. FIG. 2 illustrates a side view diagram of a print control module 20. The print control module 20 includes a transmission device 200, a power switch mechanism 300, a step switching mechanism 400, a power transmission gear 500 for driving a ribbon gear 700, and a paper feed roller gear set 800.

Figure 3:
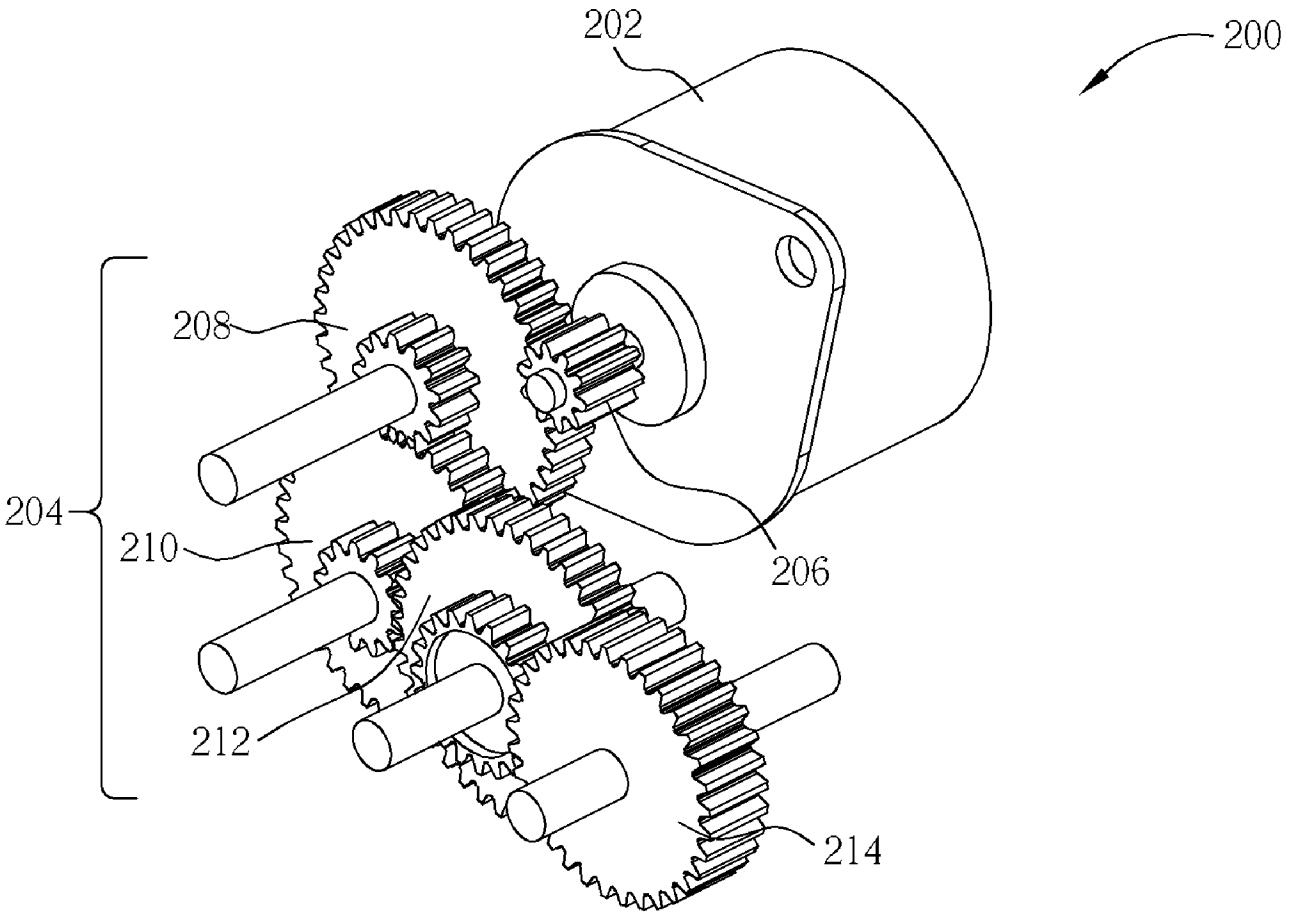
FIG. 3 illustrates a diagram of a transmission device according to the present invention.

Please refer to FIG. 3. FIG. 3 illustrates a diagram of a transmission device 200. The transmission device 200 includes a motor 202 and a transmission gear set 204. The transmission gear set 204 includes a motor shaft gear, three composite gears 208, 210, 212, and a transmission gear 214. The composite gears 208, 210, 212 can reduce a speed of the motor 202, and transmit power of the motor 202 to the power switch mechanism 300 through a transmission gear 214.

Figure 4:
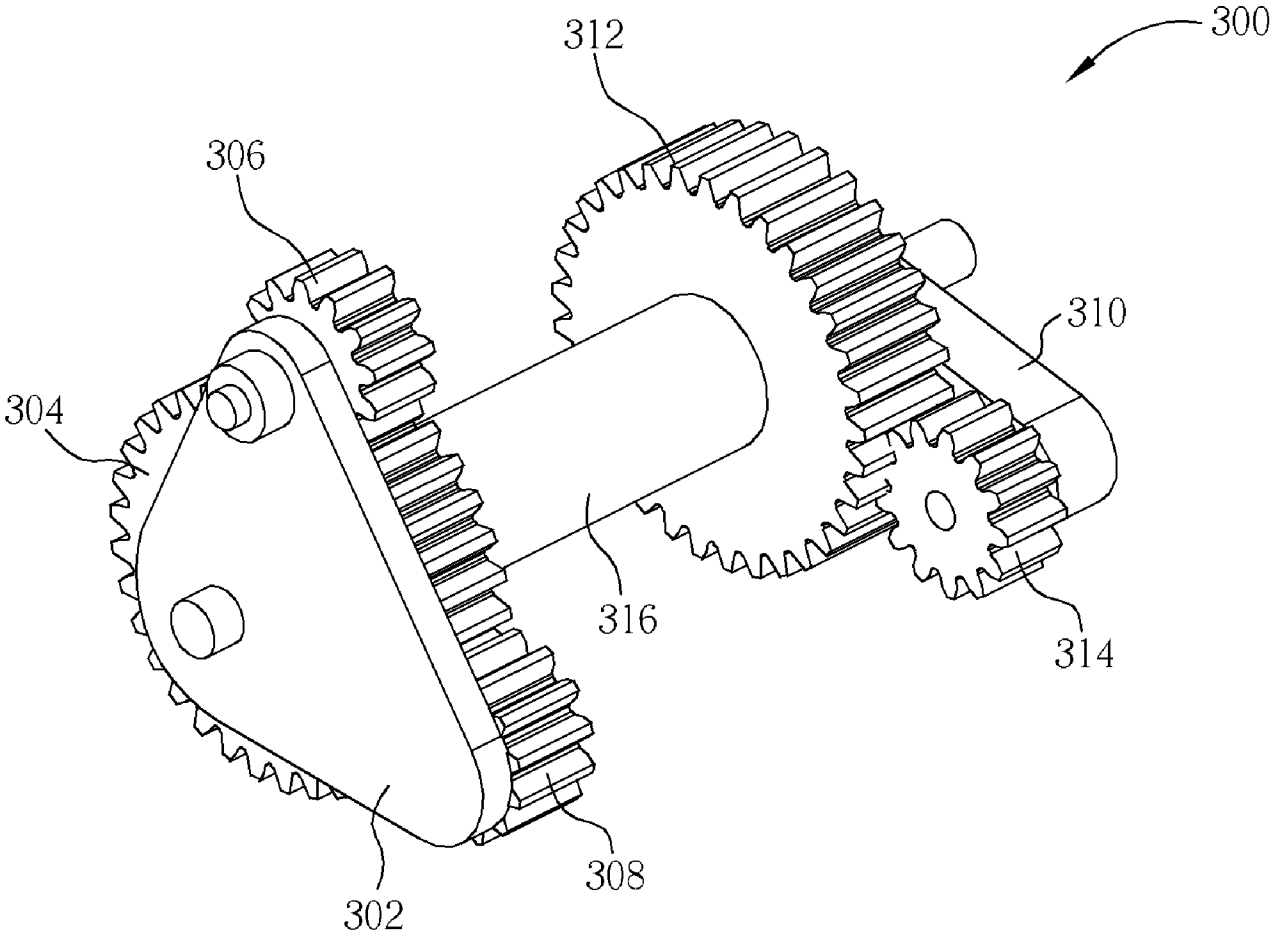
FIG. 4 illustrates a front view of a power switch mechanism according to the present invention.
Figure 5:
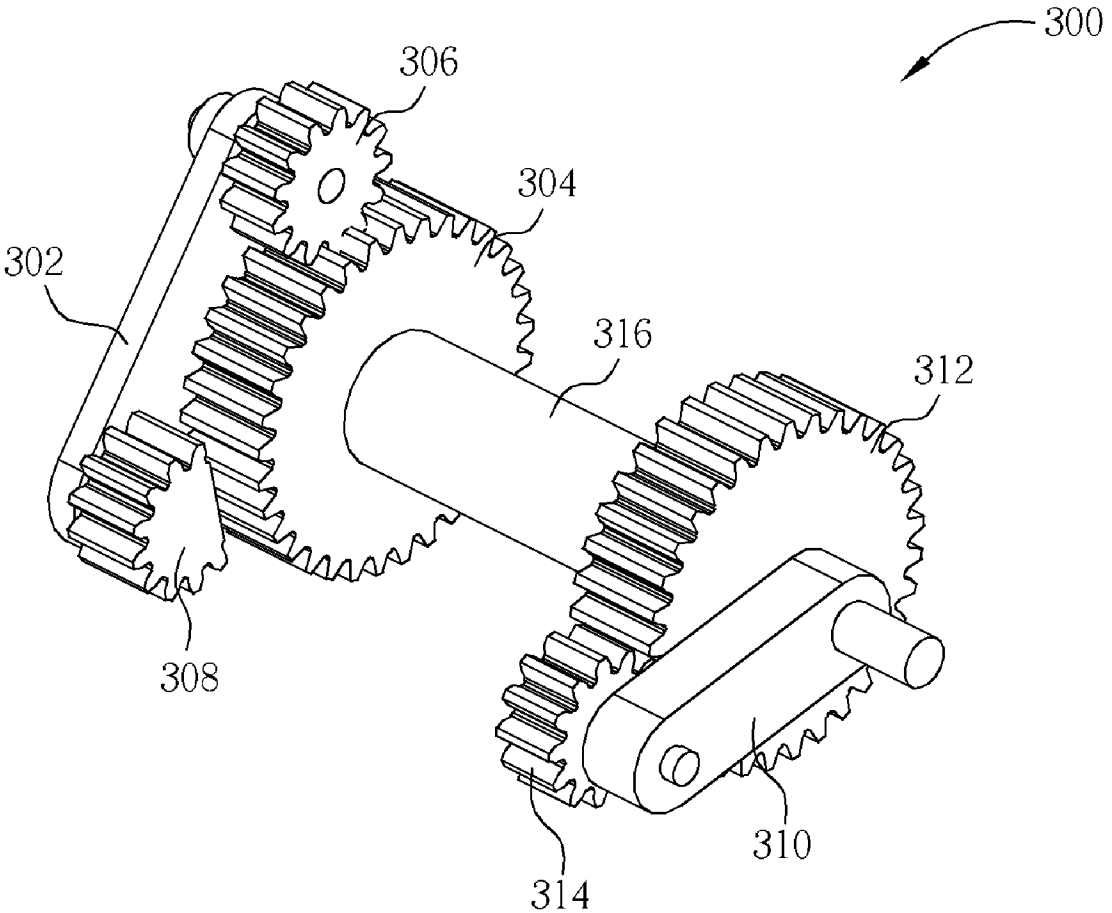
FIG. 5 illustrates a rear view of a power switch mechanism according to the present invention.

Please refer to FIG. 4. and FIG. 5. FIG. 4 illustrates a front view of a power switch mechanism 300, and FIG. 5 illustrates a rear view of a power switch mechanism 300. The power switch mechanism 300 includes a first rotating arm plate 302, a first gear 304, a first planetary gear 306, a fixed component 308, a second rotating arm plate 310, a second gear 312, a second planetary gear 314, and an axle 316. The axis of the first gear 304 and the axis of the second gear 312 are connected together through the axel 316, therefore the first gear 304 and the second gear 312 rotate together. The first gear is installed on the first rotating arm plate 302 and meshes with the transmission gear 214 of the transmission gear set 204 in a rotatable manner relative to the first rotating arm plate. The first planetary gear 306 is installed on the first rotating arm plate 302 in a rotatable manner relative to the first rotating arm plate 302, and meshes with the first gear 304 for rotating around the first gear 304. The fixed component 308 is installed on the rotating arm plate 302 for fixing the step switching mechanism 400 when the fixed component 308 meshes with the step switching mechanism 400. In this embodiment, the fixed component 308 is a tooth type structure. The second gear 312 is installed on the second rotating arm plate 310 in a rotatable manner relative to the second rotating arm plate 310. The second planetary gear 314 is installed on the second rotating arm plate 310 in a rotatable manner relative to the second rotating arm plate 310, and meshes with the second gear 312 for rotating around the second gear 312.

Figure 6:
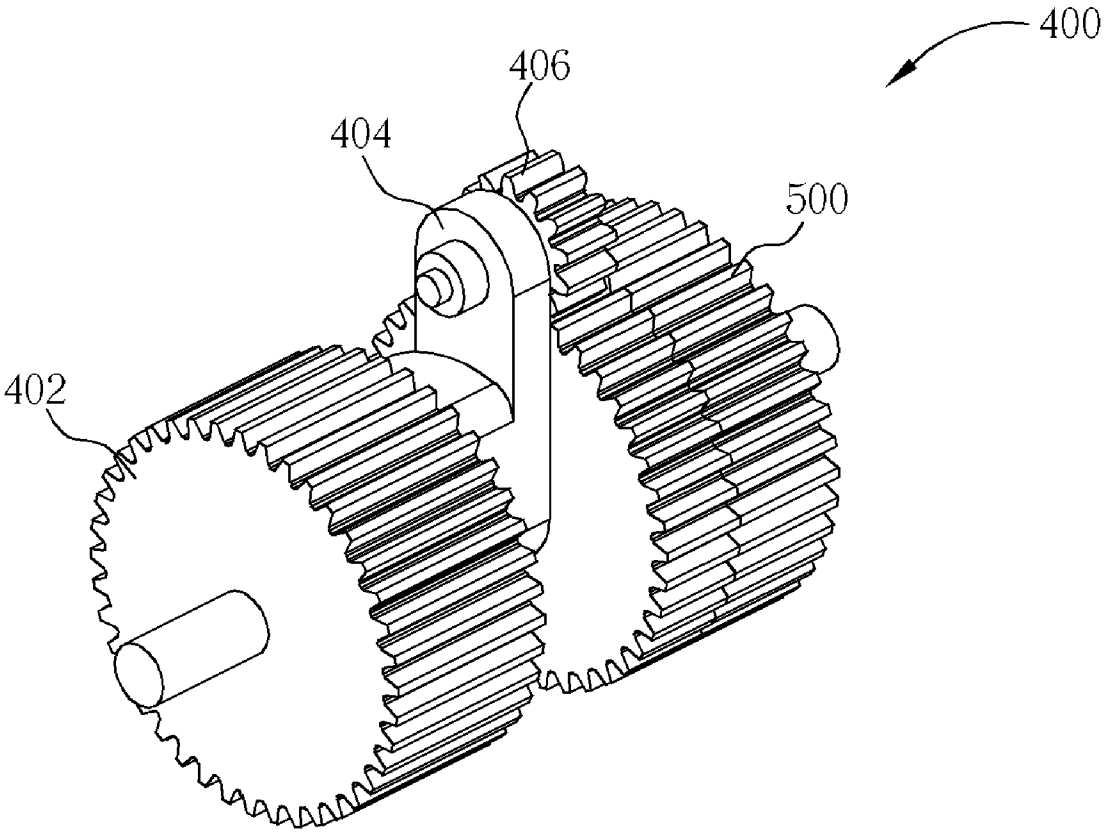
FIG. 6 illustrates a diagram of a step switching mechanism according to the present invention.
Figure 7:
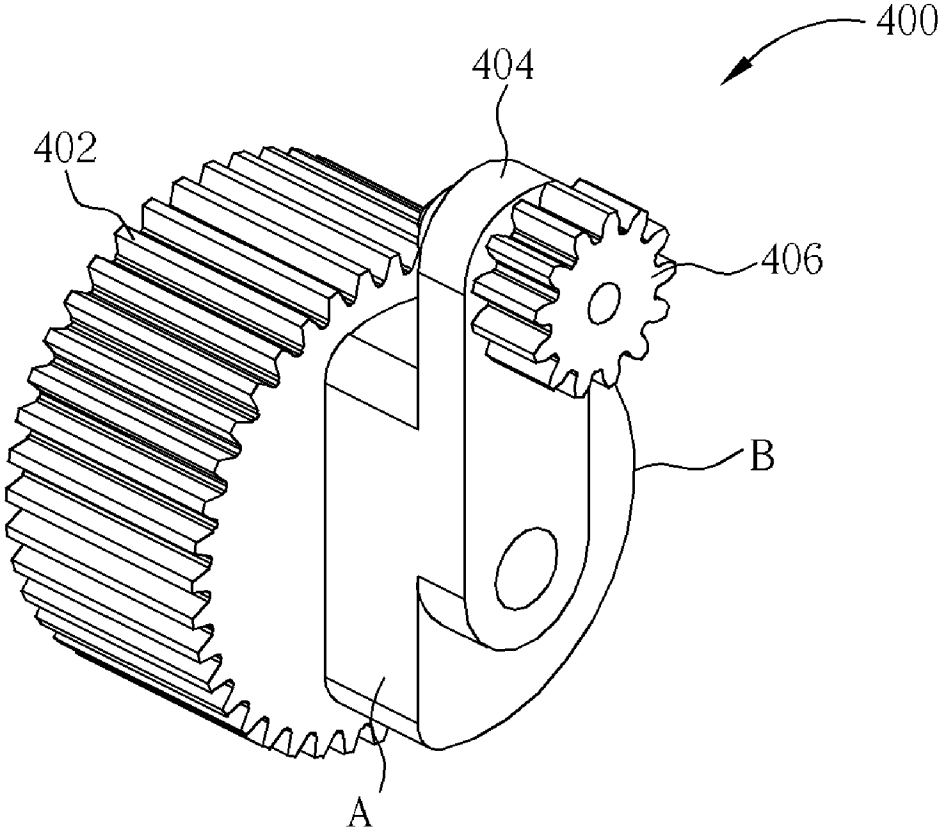
FIG. 7 illustrates a portion of components of the step switching mechanism of FIG. 6.

Please refer to FIG. 6 and FIG. 7. FIG. 6 illustrates a diagram of a step switching mechanism 400 according to the present invention. FIG. 7 illustrates a portion of components of the step switching mechanism 400 of FIG. 6. The step switching mechanism 400 includes a third gear 402, a cam rotating arm 404 and a third planetary gear 406. The third gear 402 is installed within the housing 40 in a rotating manner relative to the housing 40, and the third gear 402 meshes with the print head gear set 600. The cam rotating arm 404 is fixed on the third gear 402, which includes a flat surface A and an arc surface B. The cam rotating arm 404 through the flat surface A and the arc surface B controls a rotating arm to switch operation step. Please note that the rotating arm is not shown in FIG. 6 and FIG. 7 and will be explained in greater detail later in this disclosure. The third planetary gear 406 is installed on the cam rotating arm 404 in a rotatable manner relative to the cam rotating arm 404, and the third planetary gear 406 meshes with the power transmission gear 500 for rotating around the power transmission gear 500.

Figure 8:
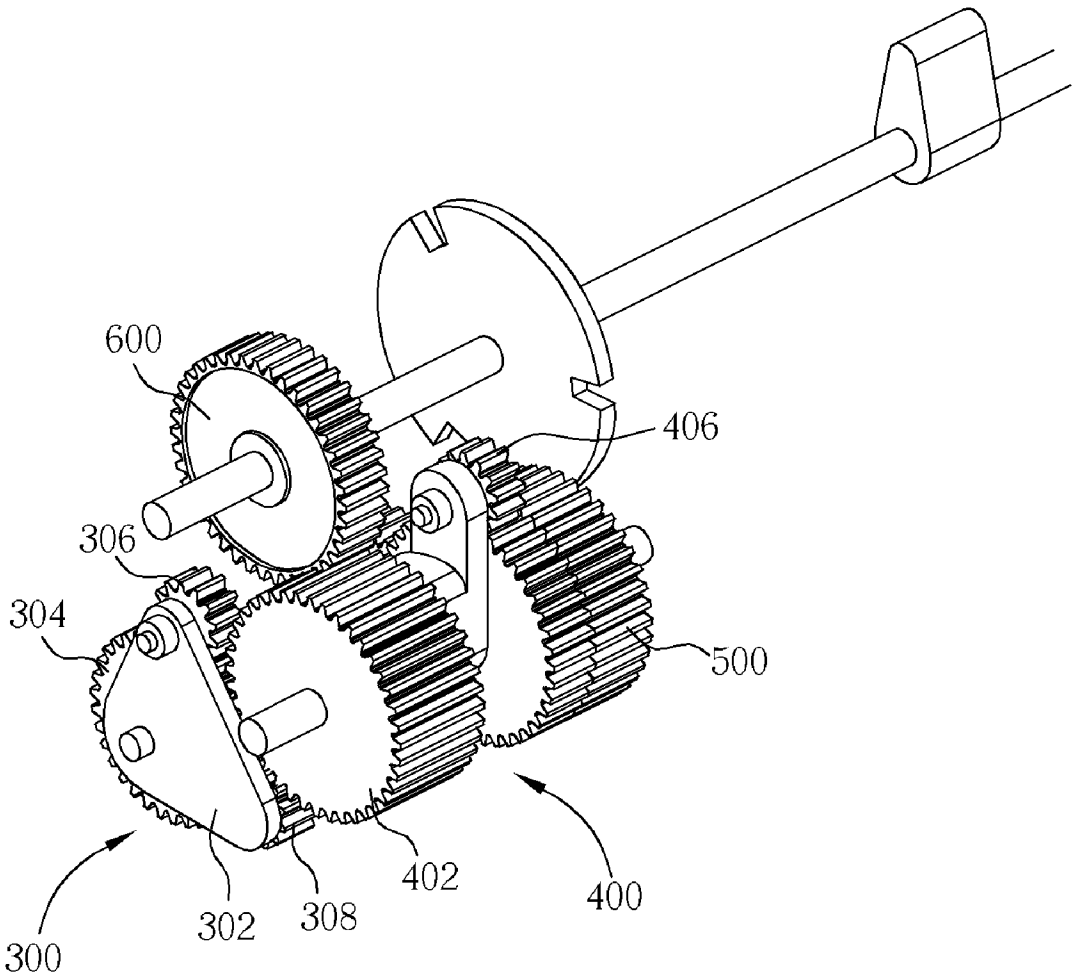
FIG. 8 illustrates an assembly diagram of a power switch mechanism and a step switching mechanism according to the present invention.
Figure 9:
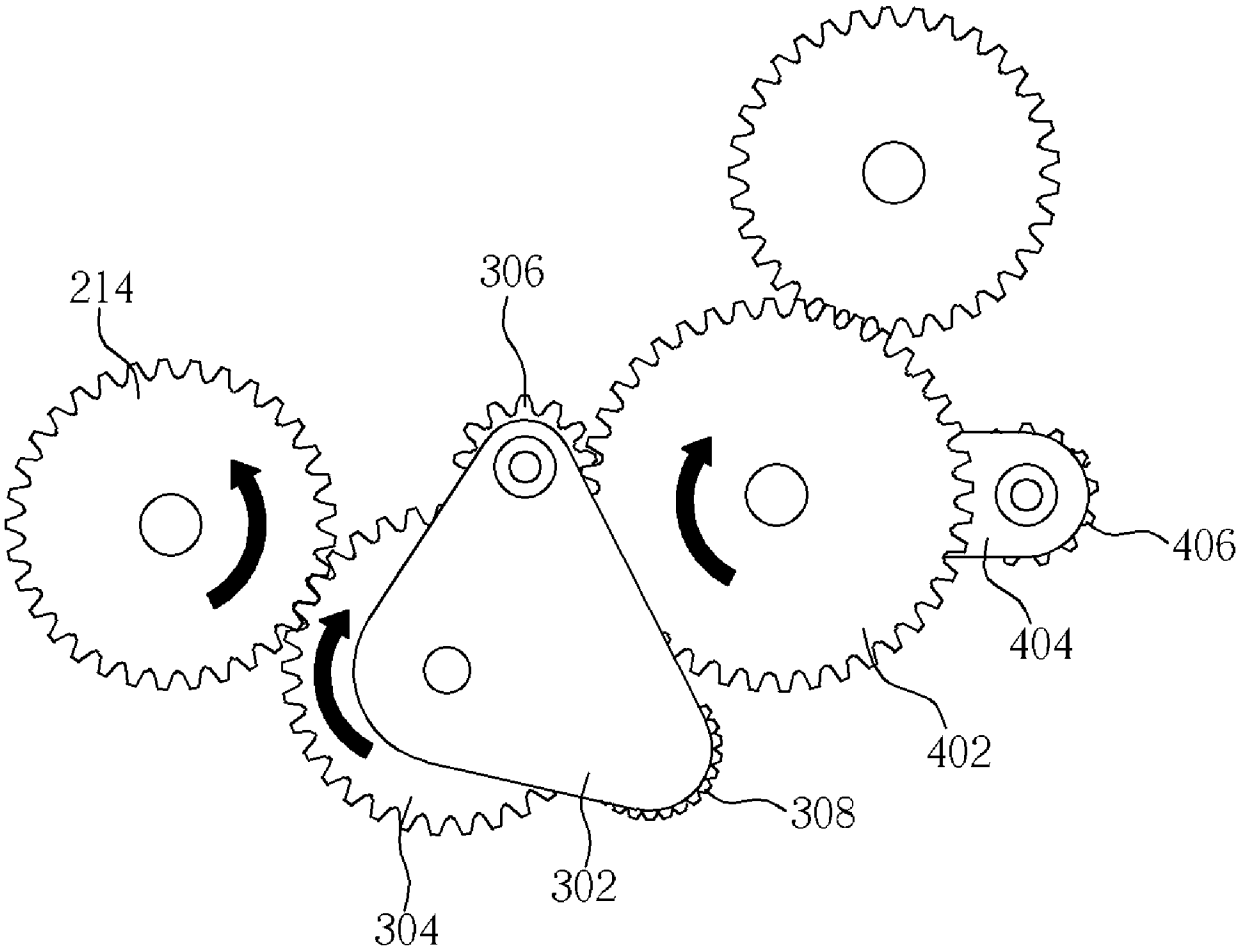
FIG. 9 illustrates an operation diagram of a power switch mechanism and a step switching mechanism according to the present invention.
Figure 10:
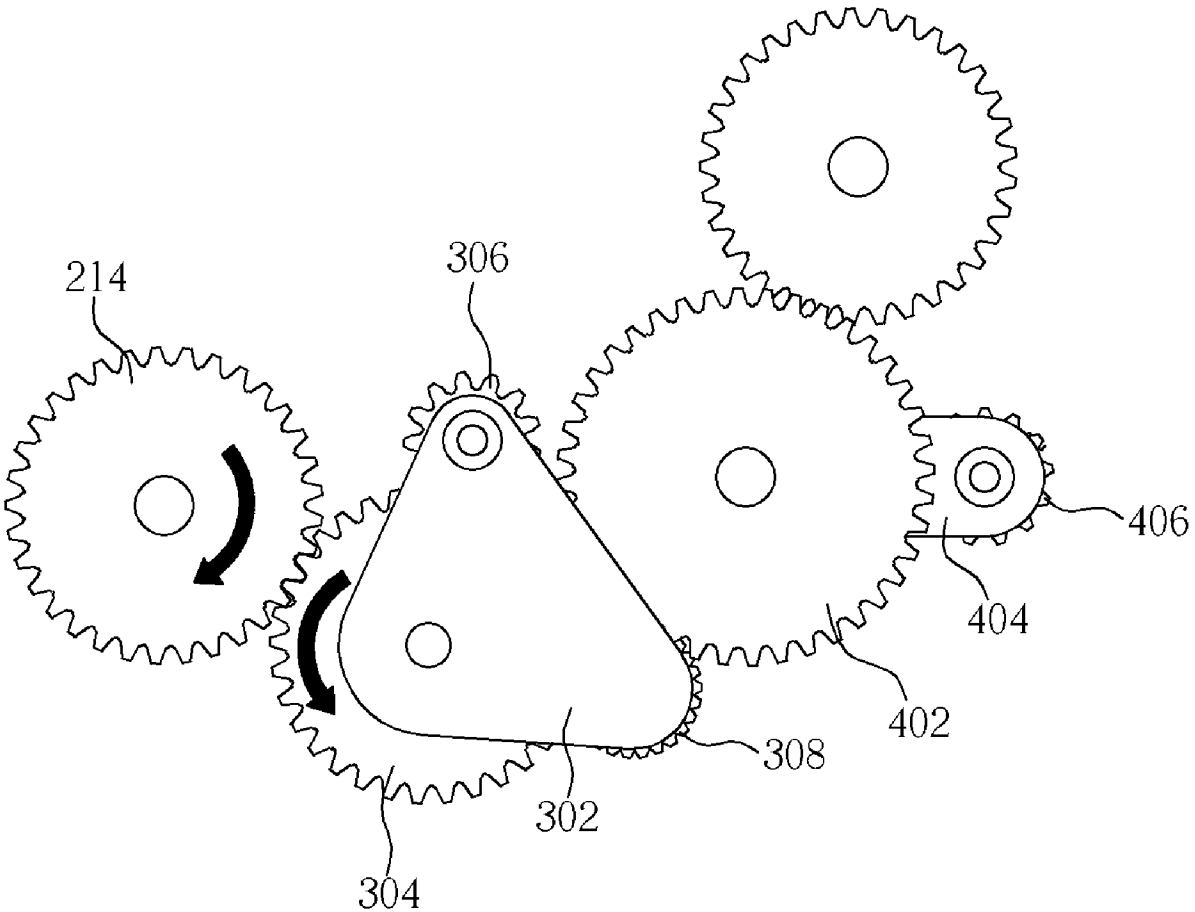
FIG. 10 illustrates an operation diagram of a power switch mechanism and a step switching mechanism according to the present invention.

Please refer to FIG. 8, FIG. 9, and FIG. 10. FIG. 8 illustrates an assembly diagram of a power switch mechanism 300 and a step switching mechanism 400 according to the present invention. FIG. 9 and FIG. 10 illustrate operation diagrams of a power switch mechanism 300 and a step switching mechanism 400 according to the present invention. Referring to FIG. 8 and FIG. 9, when the first gear 304 is rotating in a clockwise direction, the first planetary gear 306 meshes with the third gear 402. At this time, the power of the motor 202 will be transmitted to the third gear 402 through the first gear 304 and the first planetary gear 306 for changing step in a clockwise rotation. At the same time, the power of the motor 202 will be transmitted to the print head gear 500 to rotate the print head cam. Looking at FIG. 8 and FIG. 10, when the motor 202 rotates in a reverse direction, the first planetary gear 306 will be separated from the third gear 402, and the second planetary gear 306 and the fixed component 308 respectively mesh with the power transmission gear 500 and the third gear 402. At this time, the power of motor 202 will be transmitted to the power transmission gear 500 through the second planetary gear 310, and the power will further be transmitted to the ribbon shaft or the paper feed roller, and the fixed component 308 meshes with the third gear 402, thus the third gear 402 is unable to move.

Figure 11:
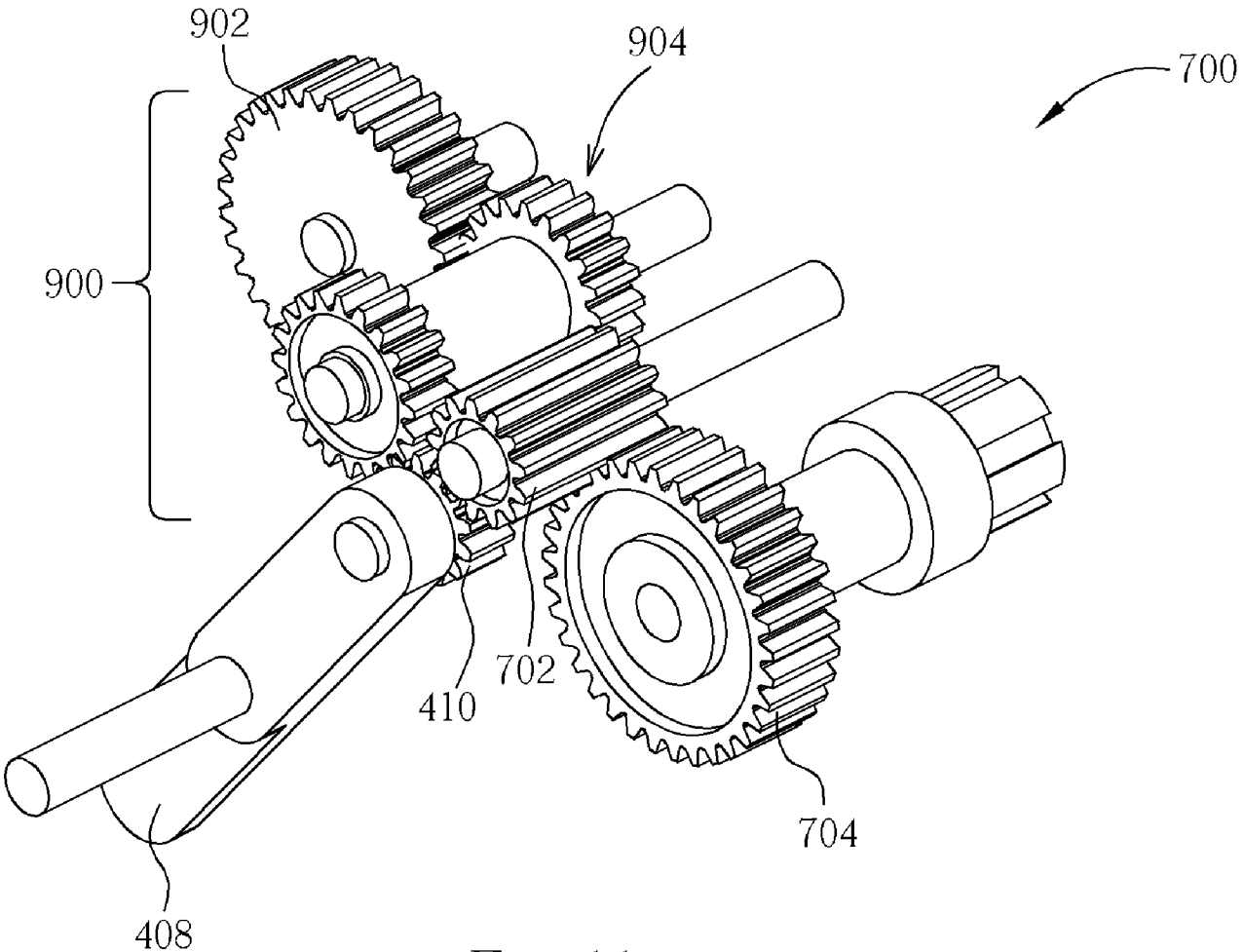
FIG. 11 illustrates a front view of a ribbon gear according to the present invention.
Figure 12:
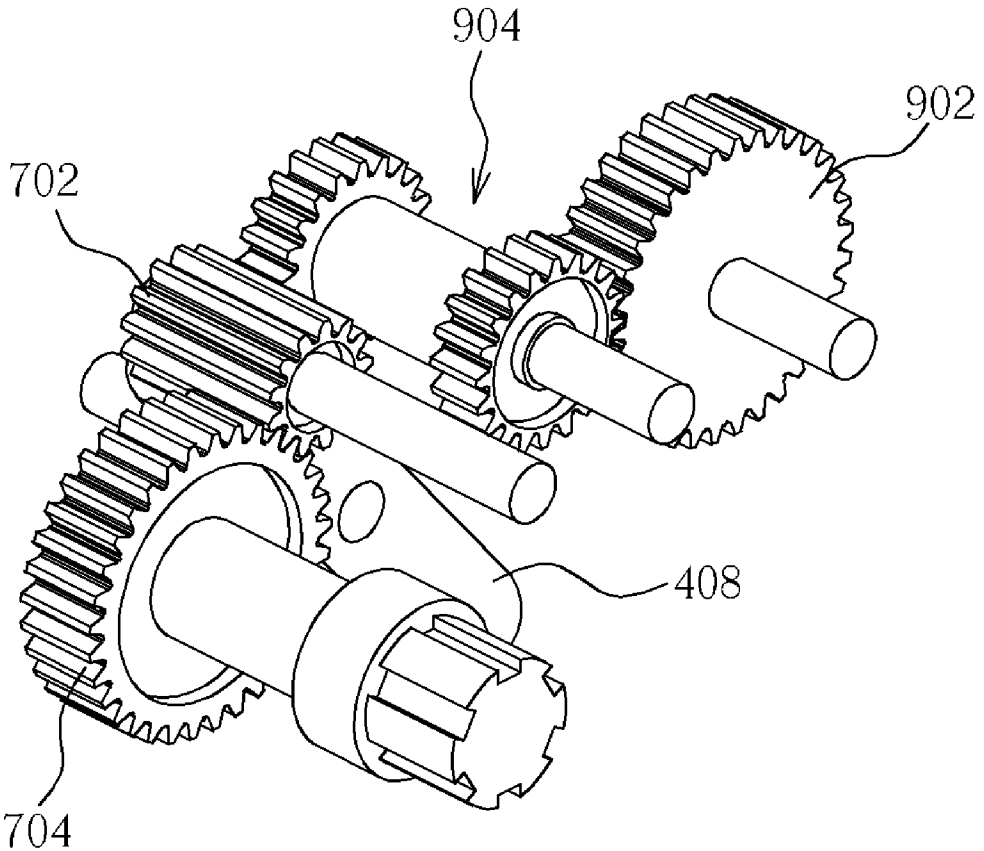
FIG. 12 illustrates a rear view diagram of a ribbon gear according to the present invention.

Please refer to FIG. 11 and FIG. 12. FIG. 11 illustrates a front view of a ribbon gear 700, and FIG. 12 illustrates a rear view diagram of a ribbon gear 700. The ribbon gear 700 includes two gears 702, 704. The gear 704 can connect with the ribbon shaft clip of the ribbon cartridge to transmit power. In FIG. 11, a rotating arm 408 is installed within the housing 40 in a rotatable manner relative to the housing 40, and one end of the rotating arm 408 is connected to the cam rotating arm 404, another end of the rotating arm 408 is connected to a clutch gear 410 movable along the arc. When the rotating arm 408 rotates to a position in FIG. 11, the power transmission gear 500 through a gear 902 and a double gear 904 of a first power transmission gear set 900 will transmit power to the two gears 702 and 704 of the ribbon gear 700 through the clutch gear 410 so as to rotate the ribbon.

Figure 13:
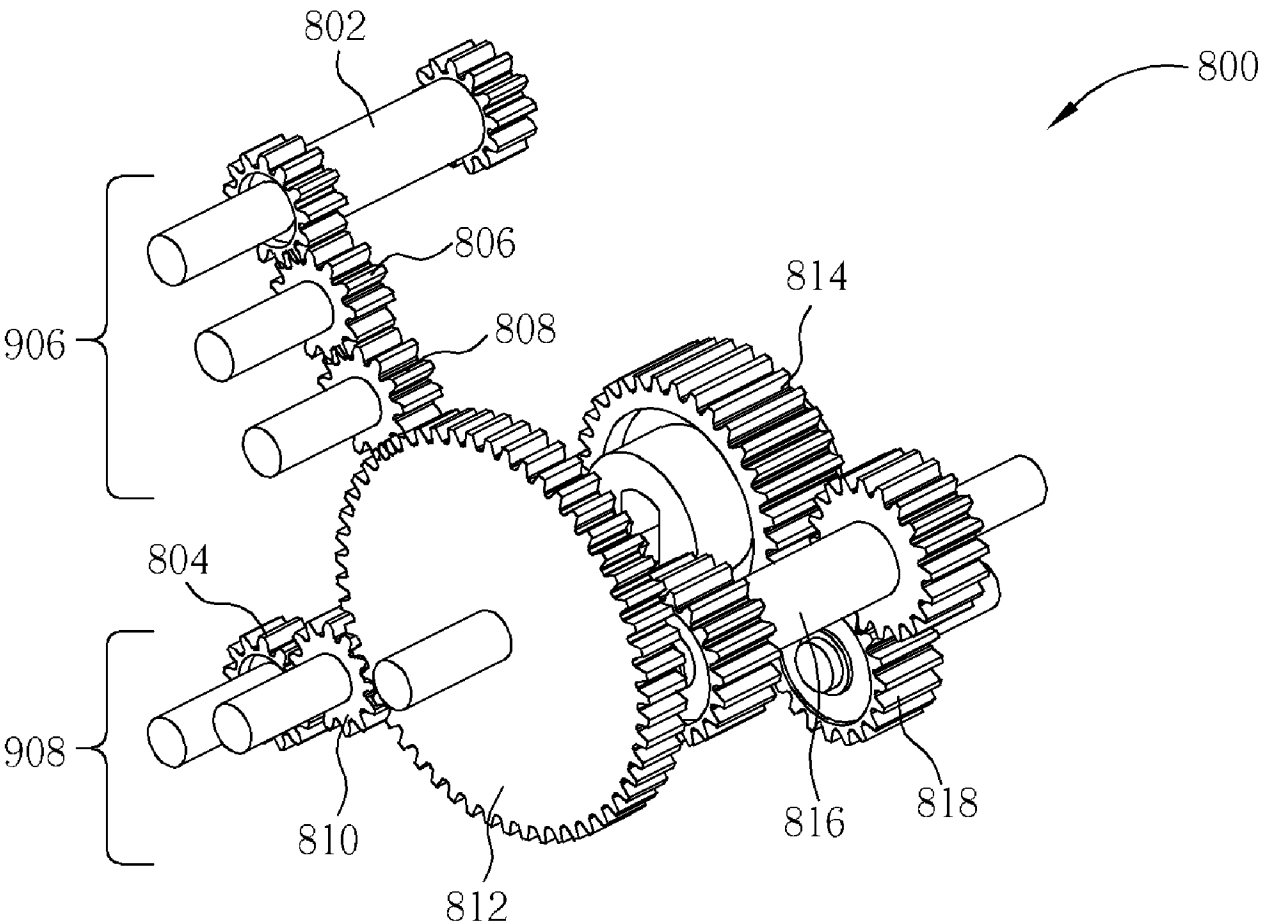
FIG. 13 illustrates a front view of a paper feed roller gear set according to the present invention.
Figure 14:
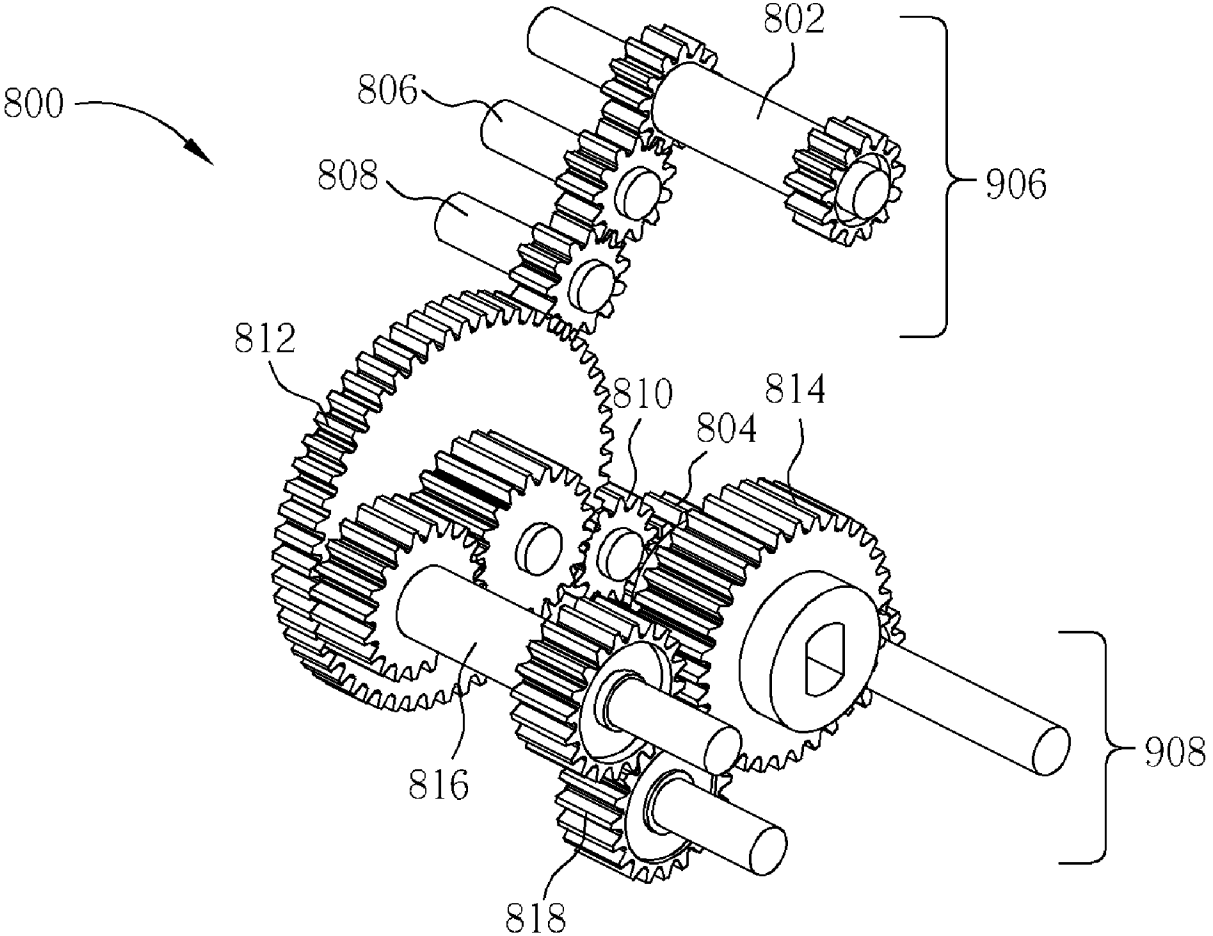
FIG. 14 illustrates a rear view of a paper feed roller gear set according to the present invention.
Figure 15:
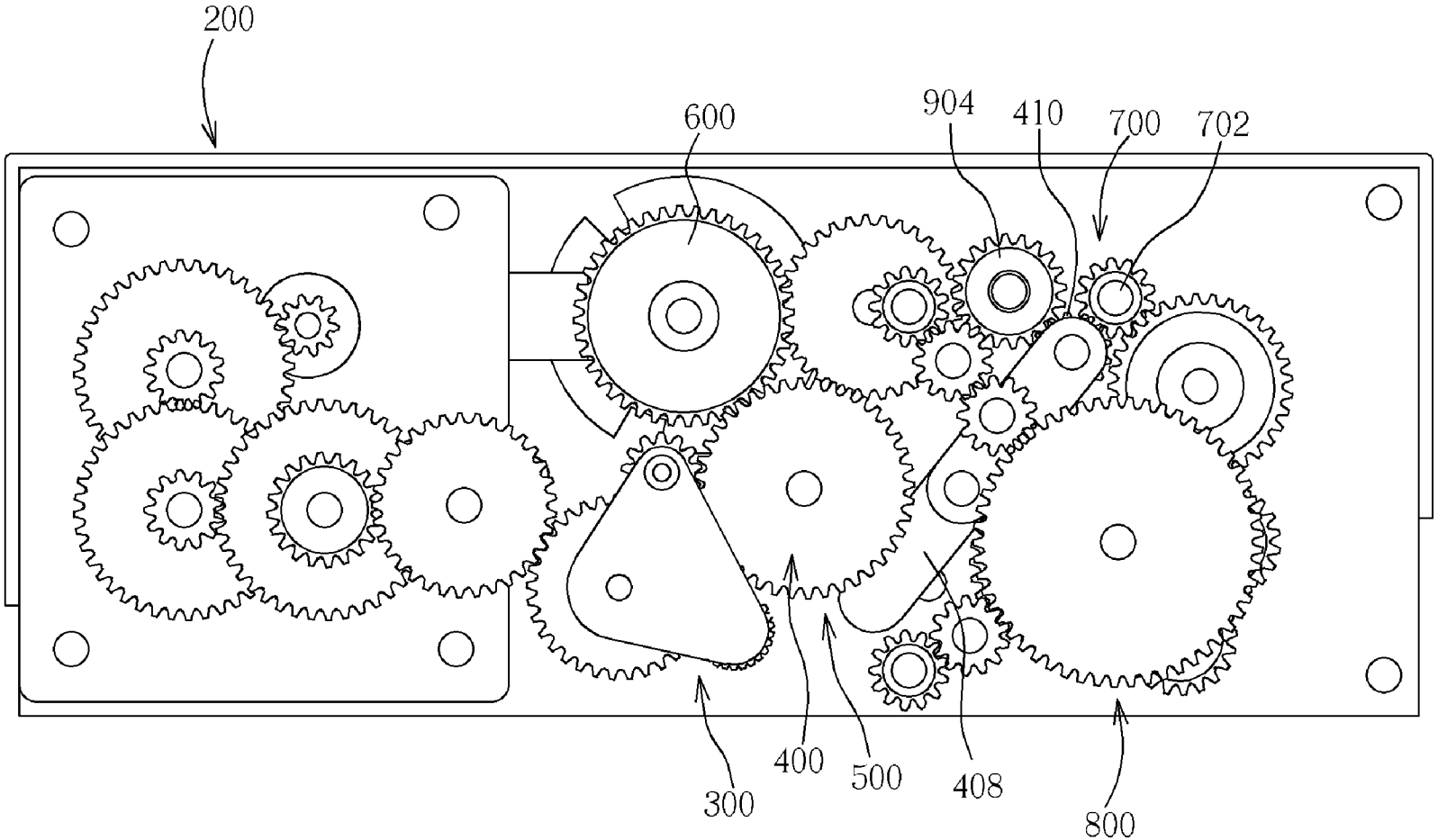
FIG. 15, FIG. 16, FIG. 17, and FIG. 18 illustrate diagrams of ribbon search of the print control module of FIG. 2.
Figure 16:
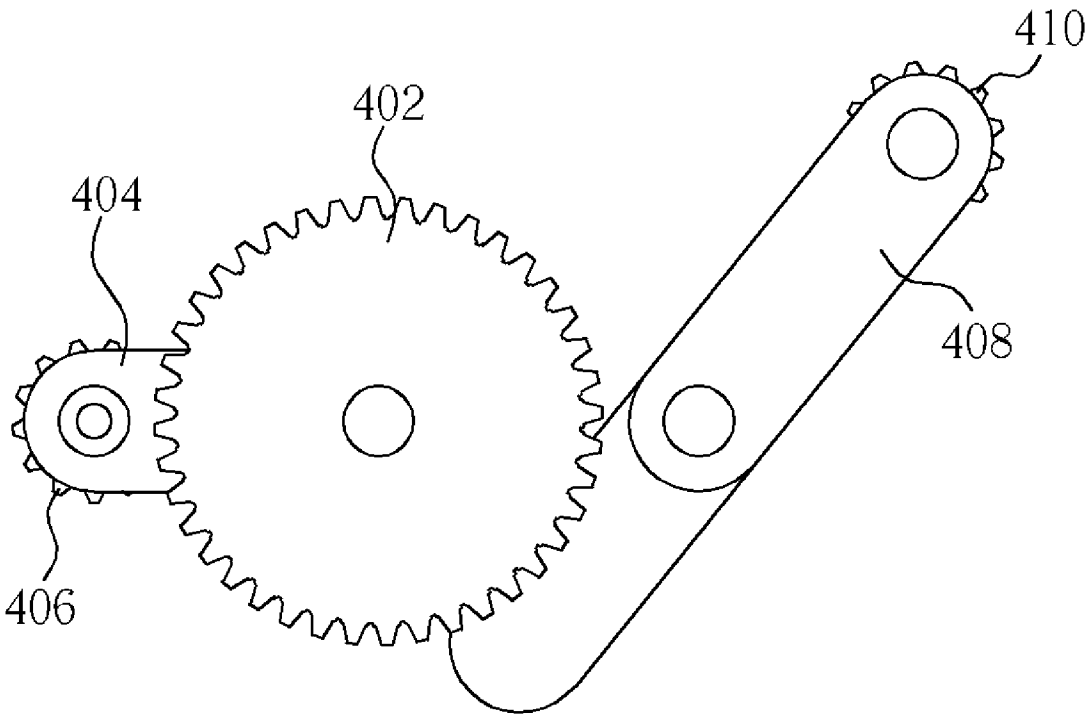
Figure 17:
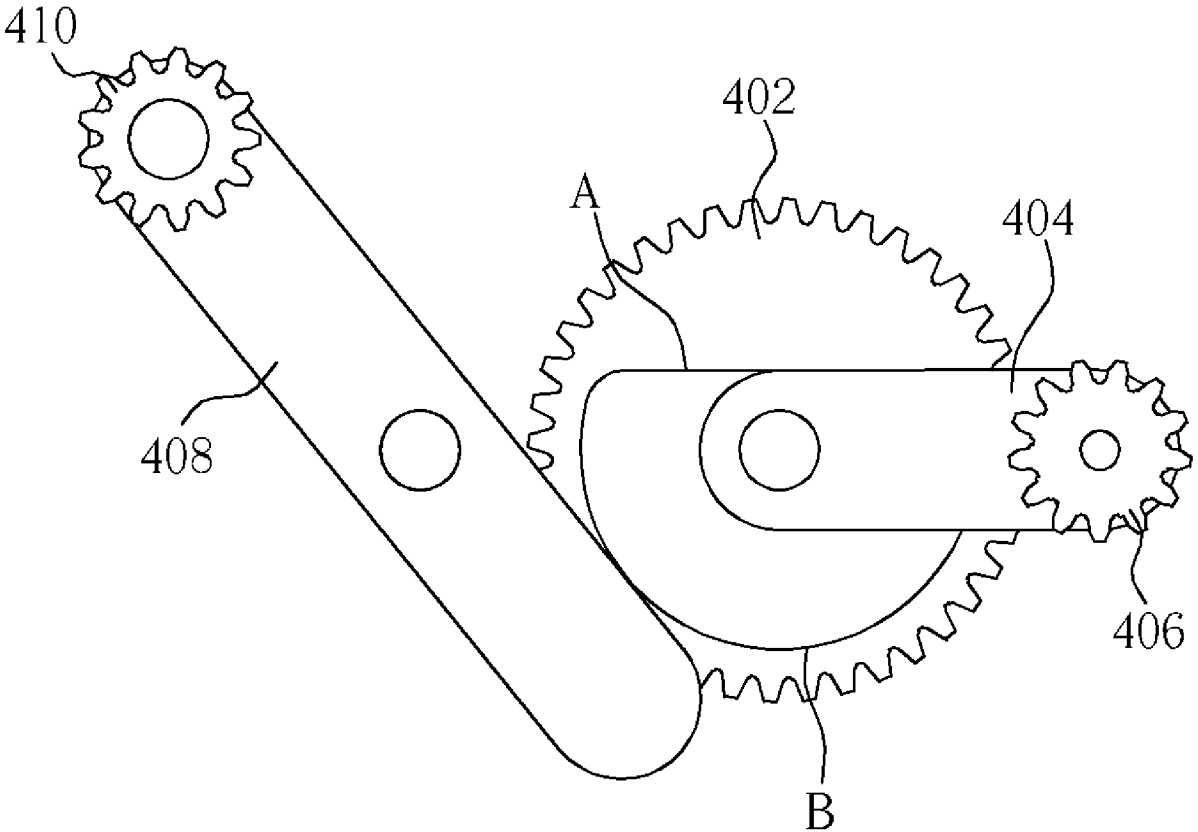
Figure 18:
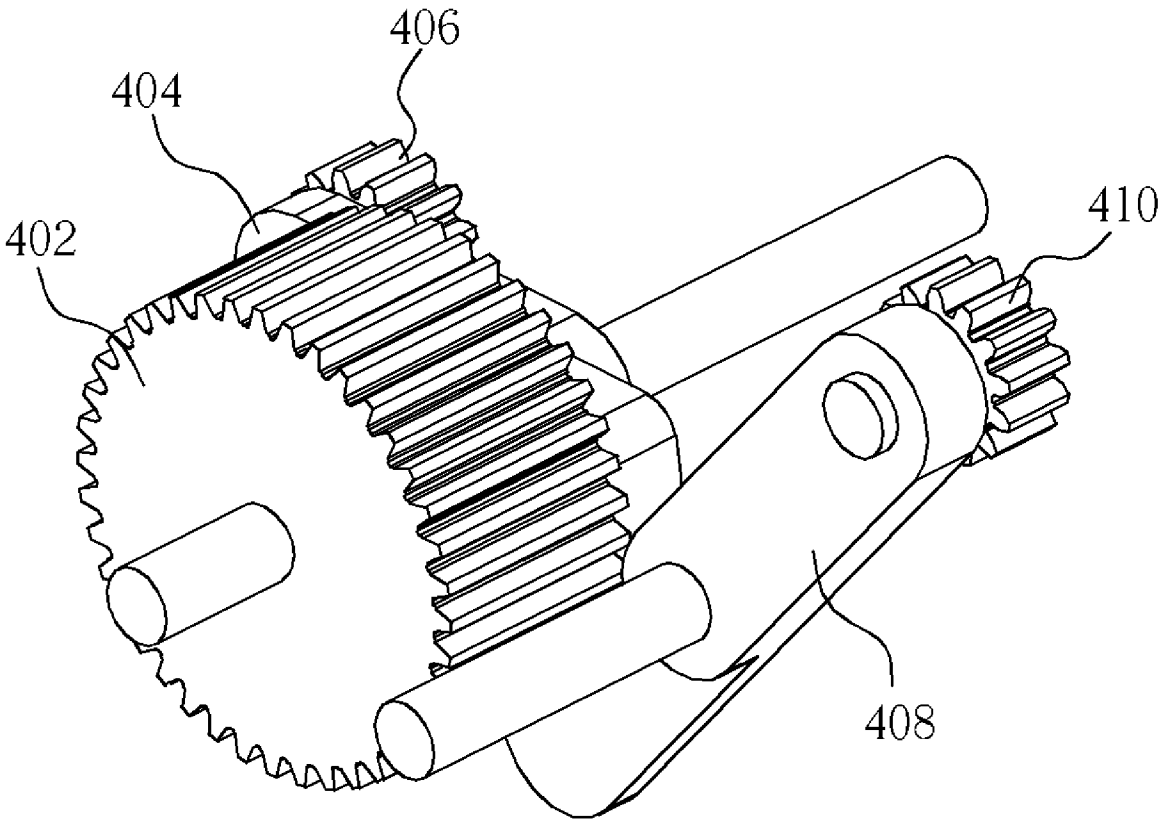
Figure 19:
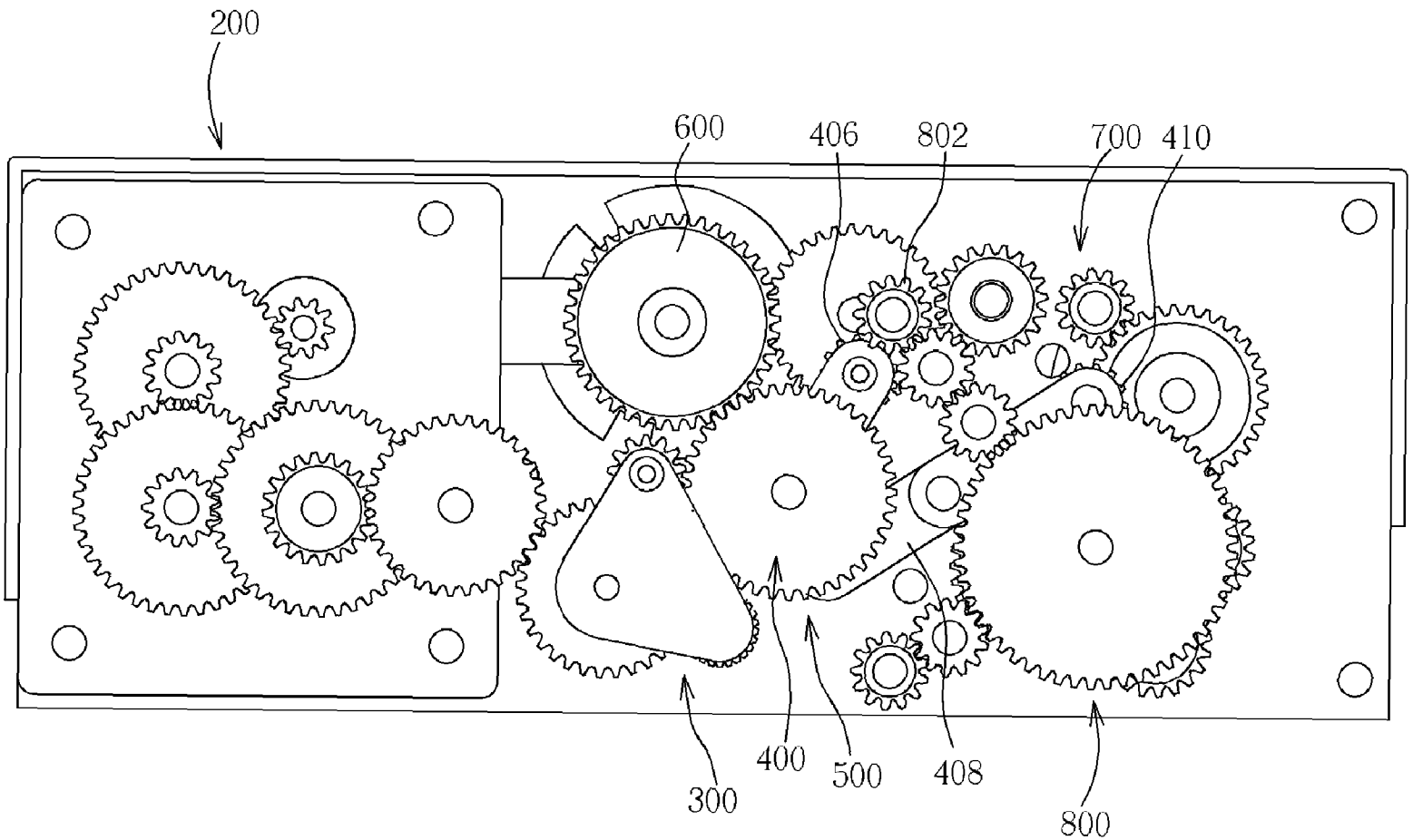
FIG. 19, FIG. 20, FIG. 21, and FIG. 22 illustrate diagrams of paper feed of the print control module of FIG. 2.
Figure 20:
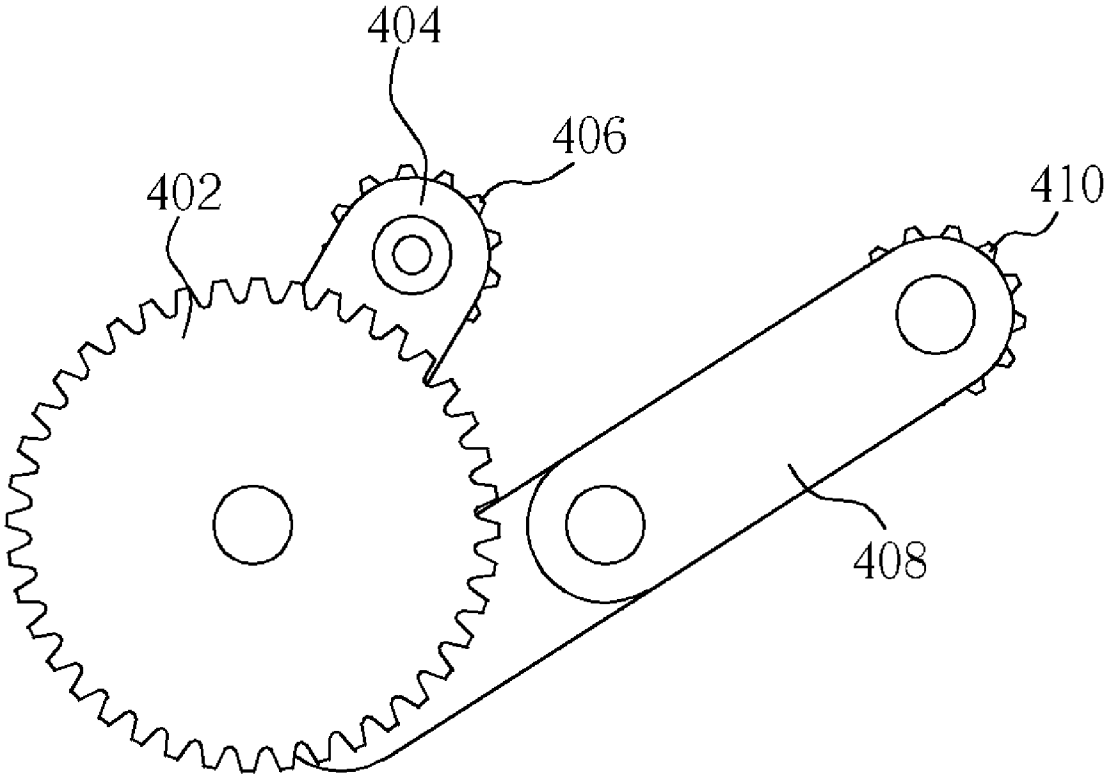
Figure 21:
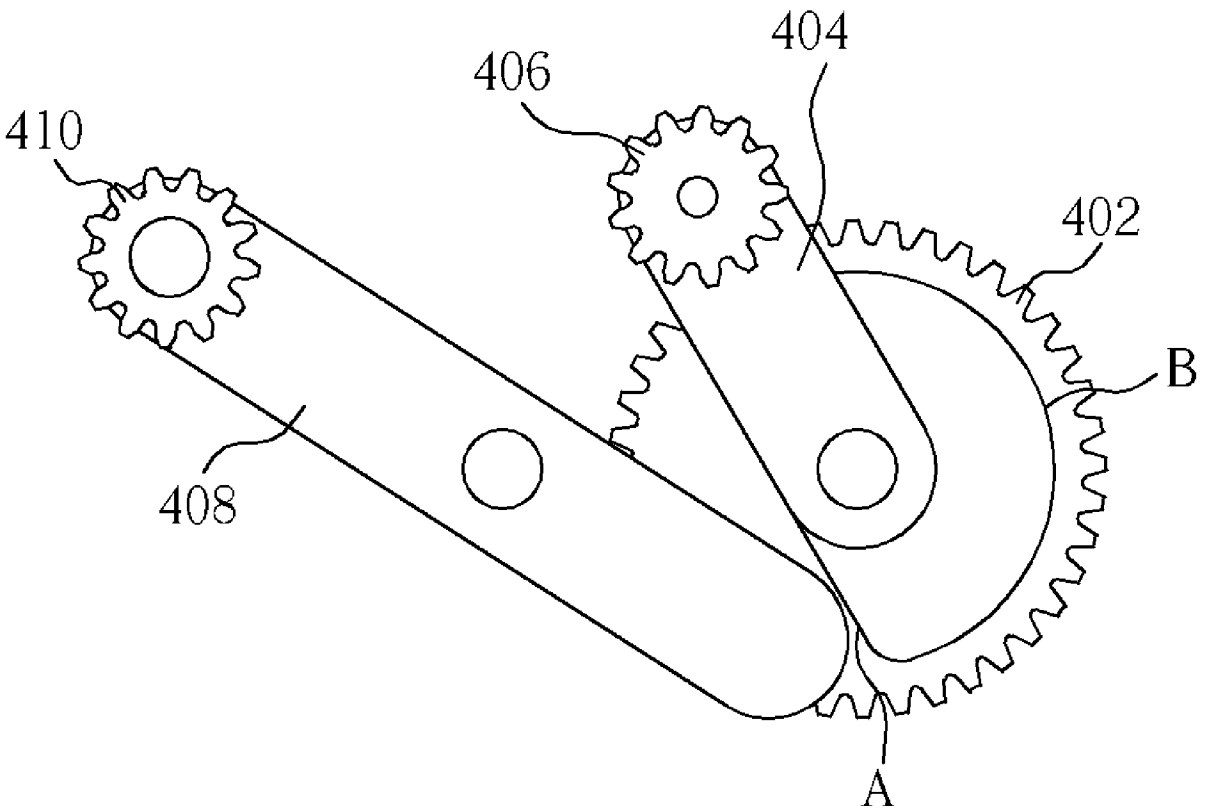
Figure 22:
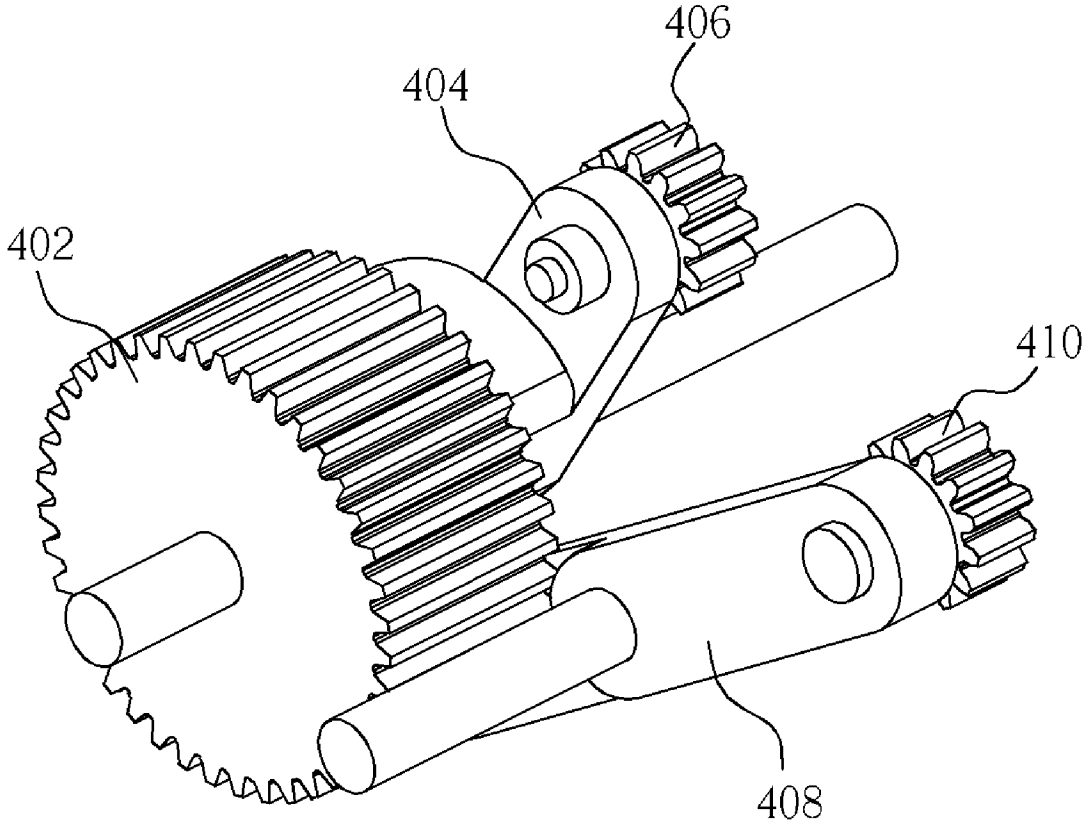
Figure 23:
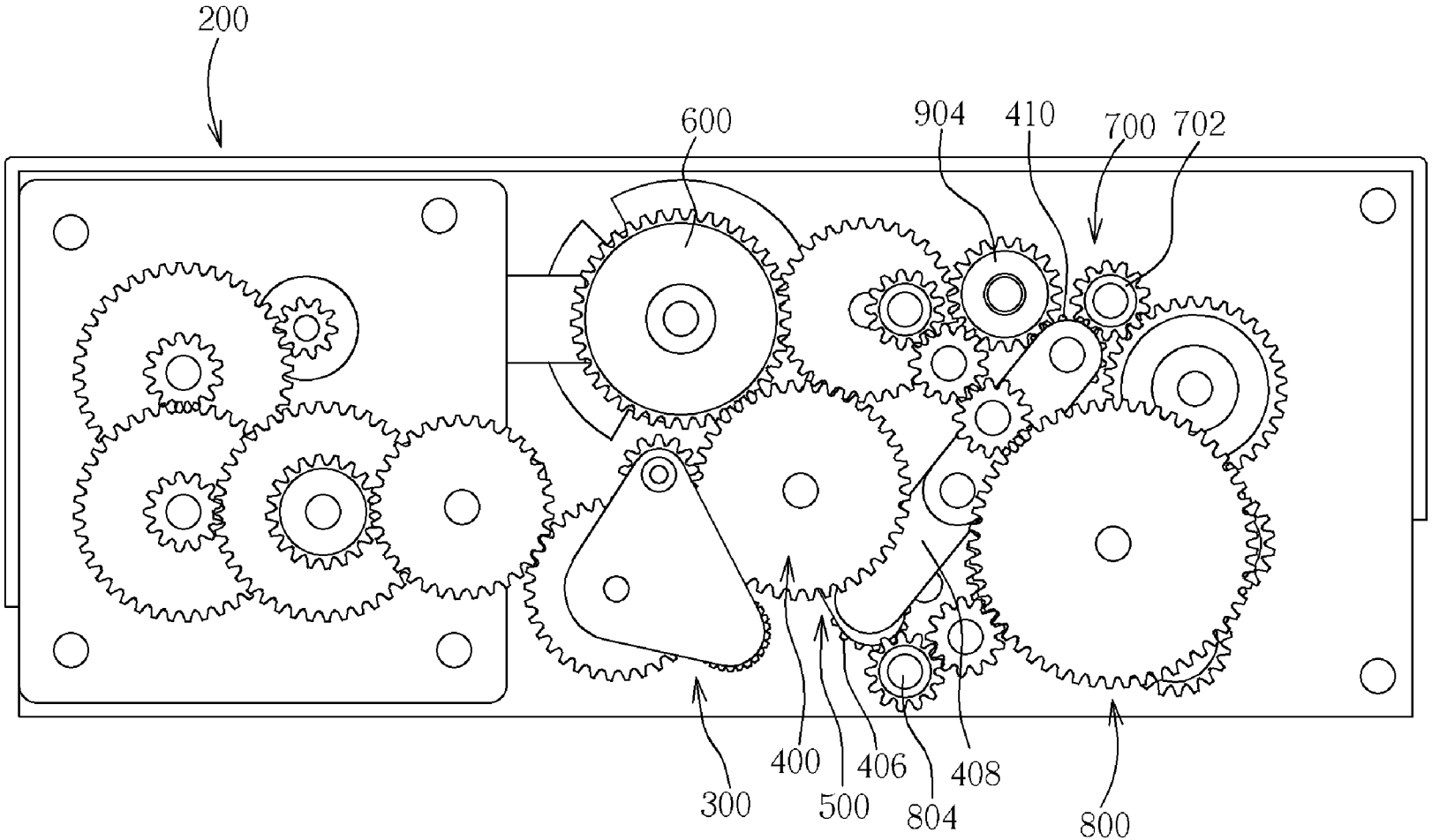
FIG. 23, FIG. 24, FIG. 25, and FIG. 26 illustrate diagrams of printing of the print control module of FIG. 2.
Figure 24:
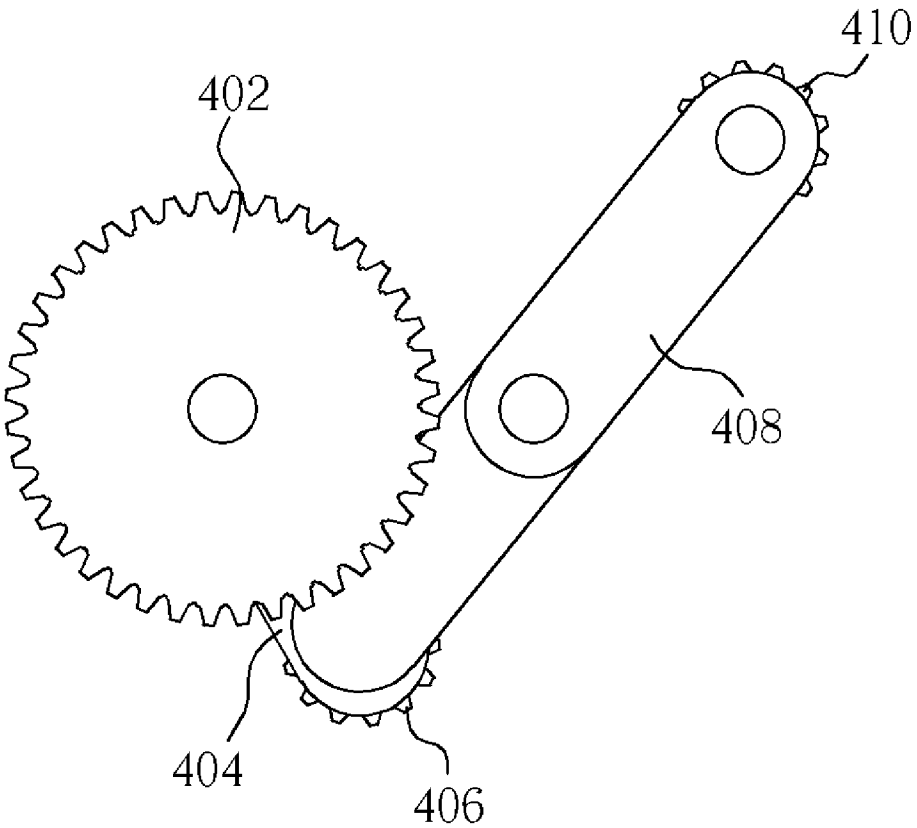
Figure 25:
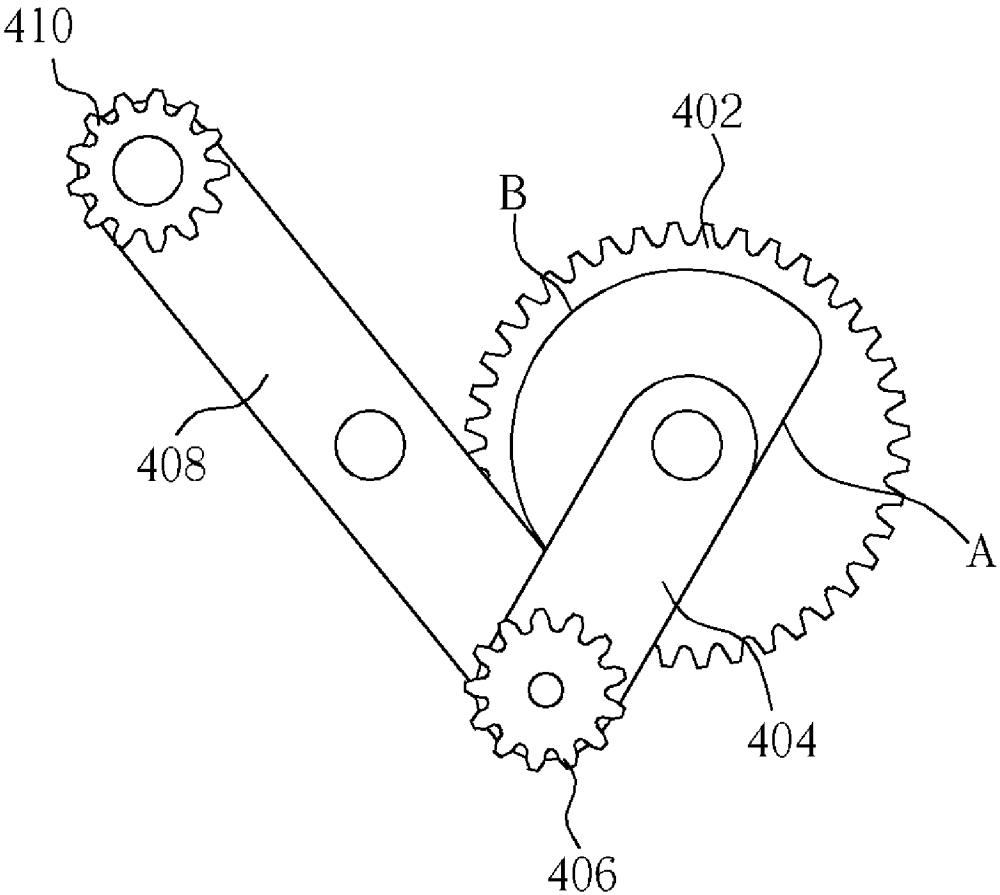
Figure 26:
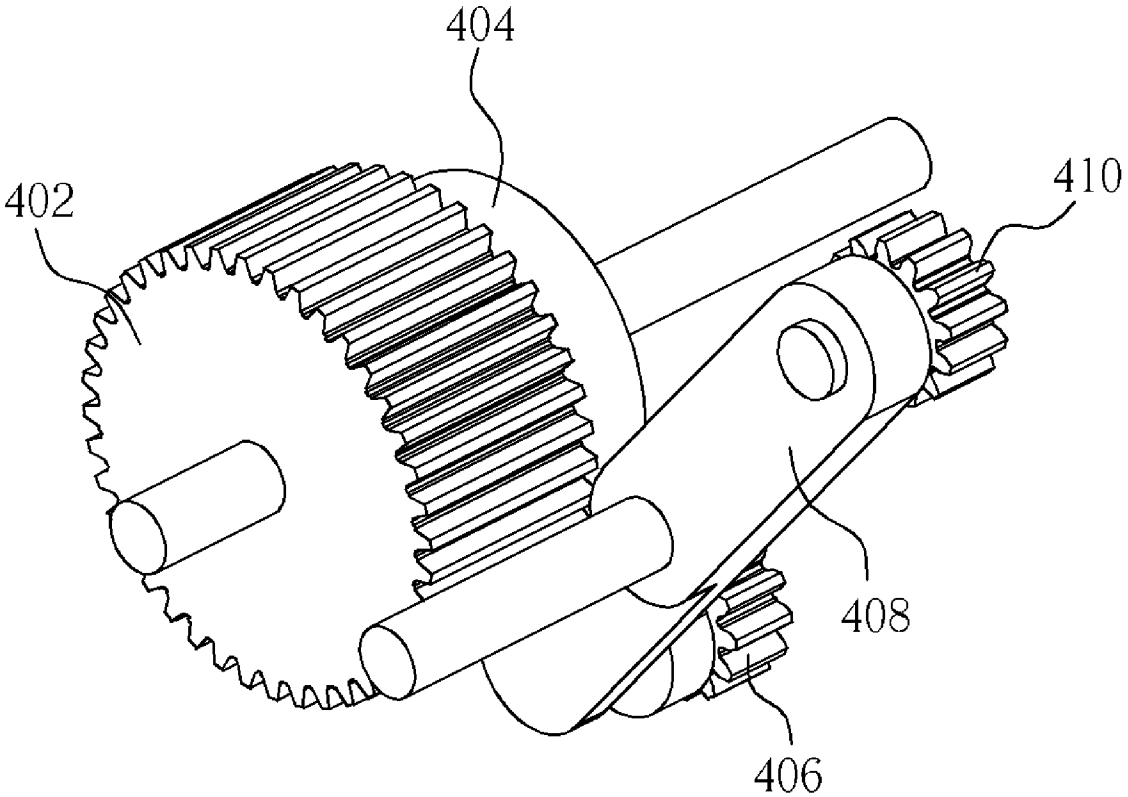

Please refer to FIG. 13 and FIG. 14. FIG. 13 illustrates a front view of a paper feed roller gear set 800. FIG. 14 illustrates a rear view of a paper feed roller gear set 800. The paper feed roller gear set 800 includes a second power transmission gear set 906, a third power transmission gear set 908, a composite gear 812, two gears 816, 818, and a paper feed roller gear 814. The second power transmission gear set 906 includes a long gear 802, and two gears 806, 808, and the third transmission gear set 908 includes a long gear 804 and a gear 810. The composite 812 can lower the rotation speed, and the paper feed roller gear 814 is fixed on the feed roller. An end of the two long gears 802 and 804 meshes with the third planetary gear 406 of the step switching mechanism 400, another end of the two long gears 802, 804 is powered by the gears 806, 808, 810 through the composite gear 812, and lastly power is transferred to the paper feed roller gear 814 to rotate the feed roller. The gear that the long gear 802 utilizes to connect to the composite gear 812 has one more gear 806 than the long gear 804, in this way the rolling direction of the paper feed roller can be changed according to the power transmitted from the long gear 802 or long gear 804.

The driving method of the print control module 20 will be described in the following.

Please refer to FIG. 15, FIG. 16, FIG. 17, and FIG. 18. When a printing operation begins, the print control module 20 will enter a step of performing ribbon searching, and at this time the motor 202 rotates in a forward direction, the power switch mechanism 300 enters into a step switching mode, the first planetary gear 306 meshes with the third gear 402, and the power of the motor 202 is transmitted to the third gear 402 through the transmission gear set 204, the first gear 304, and the first planetary gear 306 for the switching step. The third gear 402 will drive the cam rotating arm 404 to rotate such that the arc surface B is in contact with the rotating arm 408 to oppress the rotating arm 408, and in doing so the clutch gear 410 meshes with the gear 904 of the first transmission gear set 900 and the gear 702 of the ribbon gear 700. At this time, the third planetary gear 406 only meshes with the power transmission gear 500. Next, the motor 202 rotates in a reverse direction, the power switch mechanism 300 enters into a power output mode, the first planetary gear 306 is separated from the third gear 402, and the second planetary gear 314 and the fixed component 308 respectively mesh with the power transmission gear 500 and the third gear 402. Therefore, the power of the motor 202 will be transmitted to the ribbon gear 700 through the first power transmission gear set 900 and the clutch gear 410 to scroll the ribbon.

Please refer to FIG. 19, FIG. 20, FIG. 21, and FIG. 22. When the ribbon search is completed, the print control module 20 executes a next step, which is feeding of the paper. At this time, the motor 202 rotates in a forward direction, the power switch mechanism 300 enters into the step switching mode, the first planetary gear 306 meshes with the third gear 402, then the power of the motor 202 is transmitted to the third gear 402 through the transmission gear set 204, the first gear 304, and the first planetary gear 306 for performing the switching step. The third gear 402 will then drive the cam rotating arm 404 to rotate such that the flat surface A is in contact with the rotating arm 408, at this time the rotating arm 408 is not affected by the thrust of the cam, the clutch gear 410 is separated from the ribbon gear 700, and at the same time, the third planetary gear 406 meshes with the long gear 802, then the power of the transmission gear 500 will be transmitted to the paper feed roller gear 814 through the third planetary gear 406 and the long gear 802. Next, the motor 202 rotates in a reverse direction, the power switch mechanism 300 enters into a power output mode, the first planetary gear 306 is separated from the third gear 402, and the second planetary gear 314 and the fixed component 308 respectively mesh with the power transmission gear 500 and the third gear 402. Therefore, the power of the motor 202 will be transmitted to the paper feed roller gear 814 through the power transmission gear set 500, the third planetary gear 406, and the long gear 802 to feed the paper into the printer.

Please refer to FIG. 23, FIG. 24, FIG. 25, and FIG. 26. After the ribbon and the paper has reach its destination, the motor 202 rotates, the power switch mechanism 300 enters into a step switching mode, the first planetary gear 306 meshes with the third gear 402, then the power of the motor 202 is transmitted to the third gear 402 through the transmission gear set 204, the first gear 304, and the first planetary gear 306 for switching step. The third gear 402 will drive the cam rotating arm 404 to rotate such that the arc surface B is in contact with the rotating arm 408 to oppress the rotating arm 408, and in doing so the clutch gear 410 meshes with the gear 904 of the first transmission gear set 900 and the gear 702 of the ribbon gear 700. At this time, the third planetary gear 406 meshes with the long gear 804, and the cam of the print head module at the same time will oppress the print head to be in contact with the print roller. Next, the motor 202 rotates in a reverse direction, the power switch mechanism 300 enters into a power output mode, the first planetary gear 306 is separated from the third gear 402, and the second planetary gear 314 and the fixed component 308 respectively mesh with the power transmission gear 500 and the third gear 402. Therefore, the power of the motor 202 will be transmitted to the paper feed roller gear 814 through the power transmission gear set 500, the third planetary gear 406, and the long gear 804 to rotate the paper feed roller. At the same time, the power of the motor 202 is transmitted to the ribbon gear 700 through the power transmission gear 500, the first power transmission gear set 900 and the clutch gear 410 to scroll the ribbon.

Next, when a single color printout is completed, the power switch mechanism 300 enters into the step switching mode (i.e., the motor is rotating in the forward direction), such that the cam rotating arm 404 rotates until the third planetary gear 406 meshes with the long gear 802 (e.g., a paper feed step). The paper is fed into the printer again to execute a next color printout. The paper feed step and the printing step are repeated until all the colors are printed, hence the entire printout process is completed.

Therefore, the present invention can execute all printing operations through the utilization of only a single motor 202. When the single motor rotates in the forward direction, the power switch mechanism 300 enters into the step switching mode, the first planetary gear 306 meshes with the third gear 402, then the power of the motor 202 is transmitted to the third gear 402 through the transmission gear set 204, the first gear 304, and the first planetary gear 306 for switching step. When the motor 202 rotates in the reverse direction, the power switch mechanism 300 enters into the power output mode, the first planetary gear 306 is separated from the third gear 402, and the second planetary gear 314 and the fixed component 308 respectively mesh with the power transmission gear 500 and the third gear 402. The fixed component 308 fixes the third gear 402, allows the second planetary gear 314 to mesh with the power transmission gear 500, and transmits power to the ribbon shaft or paper feed roller.

In conclusion, the present invention only utilizes a single motor, which is capable of executing all printing operations, to achieve lower power consumption, and reduced usage of the motor in order to reduce cost and weight, and also during the switching step, the rotational angle of the power switch mechanism 300 is much smaller so that printing time can be reduced. Therefore, the present invention is capable of utilizing a single motor to drive the print control module to complete all printing steps in order to meet the requirement of a portable, lower cost and low power consumption printer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A print control module of a thermal printer, the print control module comprising:

a housing;

a transmission device installed within the housing, comprising:

a motor; and a transmission gear set for outputting power of the motor;

a power switch mechanism installed within the housing, comprising:

a rotating arm plate;

a first gear, installed on the rotating arm plate for meshing with a gear of the transmission gear set in a rotatable manner relative to the first rotating arm plate;

a first planetary gear installed on the first rotating arm plate for meshing with the first gear for rotating around the first gear in a rotatable manner relative to the first rotating arm plate;

a fixing component installed on the first rotating arm plate;

a second rotating arm plate;

a second gear installed on the second rotating arm plate in a rotating manner relative to the second arm plate;

a second planetary gear installed on the second rotating arm plate for meshing with the second gear for rotating around the second gear in a rotatable manner relative to the second rotating plate; and an axle connected between a spindle of the first gear and a spindle of the second gear for simultaneously driving the first gear and the second gear;

a power transmission gear installed within the housing in a rotatable manner relative to the housing; and a step switch mechanism installed within the housing, comprising:

a third gear installed within the housing for meshing with a print head gear set in a rotatable manner relative to the housing;

a cam rotating arm connecting to the third gear comprising a flat surface and an arc surface for switching operation step of the thermal printer through the flat surface and arc surface;

a third planetary gear installed on the cam rotating arm for meshing with the power transmission gear for rotating around the power transmission gear in a rotatable manner relative to the cam rotating arm;

a rotating arm installed within the housing in a rotatable manner relative to the housing, an end of the rotating arm contacting the cam rotating arm, another end of the rotating arm moving along an arc; and a clutch gear installed on another end of the rotating arm;

wherein when the motor rotates in a first direction, the first planetary gear meshes with the step switching mechanism to output power to the step switching mechanism, and when the motor rotates in an opposite direction to the first direction, the fixed component fixes the step switching mechanism, the second planetary gear meshes with the power transmission gear to transfer power to the power transmission gear;

wherein the flat surface and the arc surface control the rotation of the rotating arm so as to control the clutch gear to mesh with a ribbon gear set.

2. The print control module of claim 1 further comprising:

a first power transmission gear set for transmitting power of the power transmission gear to the ribbon gear set when the clutch gear meshes with the ribbon gear set;

a second power transmission gear set for transmitting power of the power transmission gear to the paper feed roller gear set when the second power transmission gear set meshes with the third planetary gear; and a third power transmission gear set for transmitting power of the power transmission to the paper feed roller gear set when the third power transmission gear set meshes with the third planetary gear, gears of the third power transmission gear set being one less than gears the second power transmission gear.

3. The print control module of claim 1 wherein the ribbon gear set is utilized for driving a ribbon rotation, the paper feed roller gear is utilized for driving a paper in a forward or backward direction, and the print head gear set is utilized for driving a print head to execute printing.

4. The print control module of claim 1 wherein the fixed component is a tooth type structure.

* * * * *